United States Patent [19]

Mackie

[11] 4,138,070

[45] Feb. 6, 1979

[54] YARN WINDER

[75] Inventor: Gordon Mackie, Belfast, Northern Ireland

[73] Assignee: James Mackie & Sons Limited, Belfast, Northern Ireland

[21] Appl. No.: 818,034

[22] Filed: Jul. 22, 1977

[30] Foreign Application Priority Data

Aug. 6, 1976 [GB] United Kingdom ..... 32830/76

[51] Int. Cl.[2] ..... B65H 67/04; B65H 54/42; B65H 54/54

[52] U.S. Cl. ..... 242/18 A; 242/18 DD; 242/129.51

[58] Field of Search ..... 242/18 A, 18 DD, 129.51

[56] References Cited

U.S. PATENT DOCUMENTS

| | | | |
|---|---|---|---|
| 2,337,112 | 12/1943 | King | 242/129.51 |
| 2,789,774 | 4/1957 | Petersen et al. | 242/18 A |
| 2,957,635 | 10/1960 | Bisbe | 242/18 A |
| 3,076,614 | 2/1963 | Baer | 242/18 A |
| 3,310,247 | 3/1967 | Emery | 242/18 A |
| 3,334,827 | 8/1967 | Jackson | 242/18 A |
| 3,532,278 | 10/1970 | Sparling | 242/18 A |
| 3,552,666 | 1/1971 | Stenmans et al. | 242/18 DD X |
| 3,708,133 | 1/1973 | McErlane et al. | 242/18 A |
| 3,761,029 | 9/1973 | Seney | 242/18 A |
| 4,015,786 | 4/1977 | Slavik et al. | 242/18 A |

*Primary Examiner*—Stanley N. Gilreath

*Attorney, Agent, or Firm*—Sughrue, Rothwell, Mion, Zinn and Macpeak

[57] ABSTRACT

A winding head includes a supporting frame arranged so as to be capable of movement towards or away from a package driving roller, a plurality of pairs of arms pivoted about a common axis on the supporting frame, each pair being capable of moving a package center along a part-circular path into an operative position in which the center is capable of co-operation with the driving roller and subsequently moving a package carried by the center away from the operative position, a support member carried by the frame for supporting a package center in the operative position, the support member being movable from its supporting position to release a package wound on the center and allow it to move away from the operative position, whereby successive package centers may be brought into the operative position as each package is completed.

12 Claims, 11 Drawing Figures

75
63
40
64
41
65
62
68
61
60
54
24
27
4
20A
2
21A
81
90
70
86
3
78

YARN WINDER

This invention relates to apparatus for winding yarn, which term is intended to cover natural and/or synthetic materials including filaments or tapes in a twisted and/or non-twisted condition. The invention is particularly concerned with winding apparatus for use with a machine producing yarn on a continuous basis. One example of such a machine is an open-end or so-called "break" spinning machine and the invention is particularly concerned with a winder for use with such a spinning machine, although a winder in accordance with the invention can also be used with other types of yarn production such, for example, as so-called core yarn.

One of the characteristics of an open-ended spinning machine is its ability to permit doffing and donning without interruption to the actual spinning process and in accordance with the invention, a winder which takes advantage of this characteristic includes a supporting frame arranged so as to be capable of movement towards or away from a package driving roller, a support member carried by the frame for supporting a package centre in an operative position in which the centre is capable of co-operation with the driving roller, the support member being movable from its supporting position to allow a package wound on the centre to move away from the operative position and means for controlling the movement of a package centre prior to its engagement with the support member, whereby successive package centres may be brought into the operative position. Accordingly, in operation, a package centre in the operative position is driven by the driving roller and a package is thereby wound on it, the supporting frame moving progressively away from the driving roller in the process. When the package is complete, the support member is moved away from its supporting position and thus releases the package wound on the centre and allows it to move away from the operative position, to be replaced without delay by a fresh centre which moves into the operative position under the control of the control means, whereupon a fresh package starts to be wound without delay, thus enabling the yarn-producing head to continue in operation without interruption. Similarly, when the next package is complete, it is released in its turn and a further package centre moves into the operative position, thus permitting continuous operation.

The means for controlling the movement of a package centre preferably comprises a pair of carriers with means for mounting a package centre between them, the carriers being mounted for joint movement relative the the supporting frame so as to control the movement of a package centre mounted between them along a predetermined path into the operative position and then, after release from the support member, to allow a package carried by the centre to move away. Since both carriers move in unison, both ends of the package centres move together and in this way, it is possible to exert positive control over each successive package centre both before and after the winding of the package and until the package is eventually released from between the two carriers. As each full package is released from the carriers, so a fresh, empty package centre can be fitted in position to the carriers ready to be moved into the operative position in due course.

The carriers are preferably mounted for turning movement about a common axis so that each successive package centre is moved along a part-circular path before reaching the operative position and then subsequently moves along a continuation of the same path away from the operative position. Although such turning movement is preferred because it leads to simple operation, other paths of movement are also possible and guides may be included to constrain the carriers to move as required. Whatever the path of movement, the provision of carriers maintains positive control over each successive package centre both before and after winding.

Control may, however, be maintained without the inclusion of carriers. For example, mounting means for each package centre may comprise a pair of separate caps or bushes capable of sliding in guides. The package centre or its mounting means which is the next one to be moved to the operative position may be supported above the operative position either by direct engagement with the package being wound or by a separate support member which may be an extension of the support member engaging the package being wound. In either case, as soon as the completed package is released, the next centre falls into the operative position where it is engaged by the support member and winding continues as previously described. The guides for the mountings for the centres may accommodate more than one centre in reserve and may, in fact, constitute a magazine which is replenished with centres periodically and operates to release one centre from the bottom each time a package is complete.

When using carriers mounted for turning movement, these preferably comprise a number of pairs of arms pivoted about a common axis, each pair being capable of moving a package centre along a part-circular path into the operative position and subsequently moving a package carried by the centre away from the operative position. In practice, two such pairs of arms is sufficient in that, when a completed package carried by one pair of arms moves away from the operative position, a fresh package centre carried by the other pair of arms moves into the operative position. While the next package is being wound, the previous package can be released from between the pair of arms, a fresh centre fitted between and the arms swung through an arc of a circle until the fresh package centre is located in position ready to take over from the package being wound as soon as that package is complete. The fresh package centre may, for example, merely rest against the package being would so that as soon as that package is released, the fresh centre automatically falls into position. Alternatively, the fresh centre may be supported above the package being wound and may be released simultaneously with the release of the completed package so as to fall into the operative position.

As already mentioned, two such pairs of arms are sufficient in practice, although more than two pairs may be provided under some circumstances. Instead of being in the form of separate pairs of arms, the carriers may be constituted by a pair of rotary plates, e.g. in the form of discs, with means for mounting the package centres between them at equi-angular intervals. For example, the plates may have four sets of mounting means arranged at intervals of 90° so that each time a package is complete, the weight of the package turns the plates through 90° to bring the next centre into the operative position. At this stage, further rotation of the plates is prevented by engagement of the support member with the next package centre or a co-operating notch or abutment on the disc. The number of sets of mountings on the plates is by no means critical except that there must, of course, be at least two, in which case they are spaced 180° apart. Such an arrangement is similar to the inclusion of two pairs of separate arms except that the sets of mountings for the package centres are inter-connected and when the operator has removed a completed package and replaced it by a fresh centre, no further action is required by the operator since the centre is automatically moved from that position and into the operative position by the movement of a completed package from the operative position.

When using carriers which move in unison, a single support member engaging one of the or each pair of carriers, is sufficient, but if separate mountings for the package centre are provided which are merely slidable in guides, a separate support member for each mounting will, in general, be required although it is possible for a single support member to engage the empty package centre mid-way along its length.

The means for mounting a package centre between the carriers preferably comprises a pair of end caps mounted for rotation in the respective carriers and in order to permit the introduction and removal of a package centre these are conveniently resiliently yieldable in relation to one another. When the carriers are in the form of a number of pairs of arms, at least part of one arm of each pair may be hinged to provide the relative yielding of the end caps. When using other forms of carrier, however, one or both of the end caps may be axially slidable under spring control and such an arrangement may also be used with carriers in the form of pivoted arms.

When a completed package moves away from the driving roller on the completion of winding, it is convenient that it should be released automatically from between the carriers. Preferably, therefore, each end cap includes a central plug for fitting into the hollow interior of a package centre and the plug of at least one of the end caps is tapered to provide a camming action to force the end caps apart under a transverse force in excess of the weight of a complete package. Consequently, as the package falls away from the operative position, the momentum acquired is sufficient to force the end caps apart and thus to free the package.

Most simply, the operation is manually controlled. Thus, when using a pair of carriers, the support member may be temporarily withdrawn under manual control so as to release a completed package and allow it to fall and thus to turn the carriers, the support member being returned without delay so as to support the next centre as it moves into the operative position. As the completed package falls, it carries the yarn end with it and the operator needs to cut the trailing end so as to start the next package. In order to assist the yarn end to grip the package centre, one or both end caps of the centre may be roughened or barbed, the operator ensuring that the yarn end engages this end cap.

Automatic operation is rather more complicated, but is nevertheless preferred. Automatic doffing is initiated by a device responsive to the package having reached a predetermined size. This is preferably in the form of a yardage counter, but as an alternative a detector may sense either the diameter or weight of the package and provide an initiating signal accordingly. This moves the support member to release the completed package and immediately thereafter returns the support member to its operative position in relation to the supporting frame. In order to provide a counterpart of the manual operation, a pivoted member is preferably operated in timed relation with the movement of the support member for removing yarn being wound from a guide for traversing the yarn along a package. In addition, a blade may be provided for cutting the yarn, also in timed relation with the movement of the support member, the resultant accumulation of yarn being collected in a receptacle having means for moving it into the path of the yarn also in timed relation with the movement of the support member. This receptacle may be in the form of a shallow tray which is located immediately adjacent the end cap of the next package centre which has moved into position. If this end cap is roughened, the build up of yarn in the tray causes the yarn to be engaged by the roughened end cap after a short space of time and winding then starts automatically, the tray being returned to its inoperative position after a time delay. During the interval between the release of a completed package and the operation of the cutting blade, any yarn may conveniently be taken up by a suction device.

Two constructions of apparatus in accordance with the invention will now be described, by way of example, with reference to the accompanying drawings, in which:

FIGS. 1A to 3A are end views to a reduced scale corresponding respectively to FIGS. 1 to 3;

Figure 1:
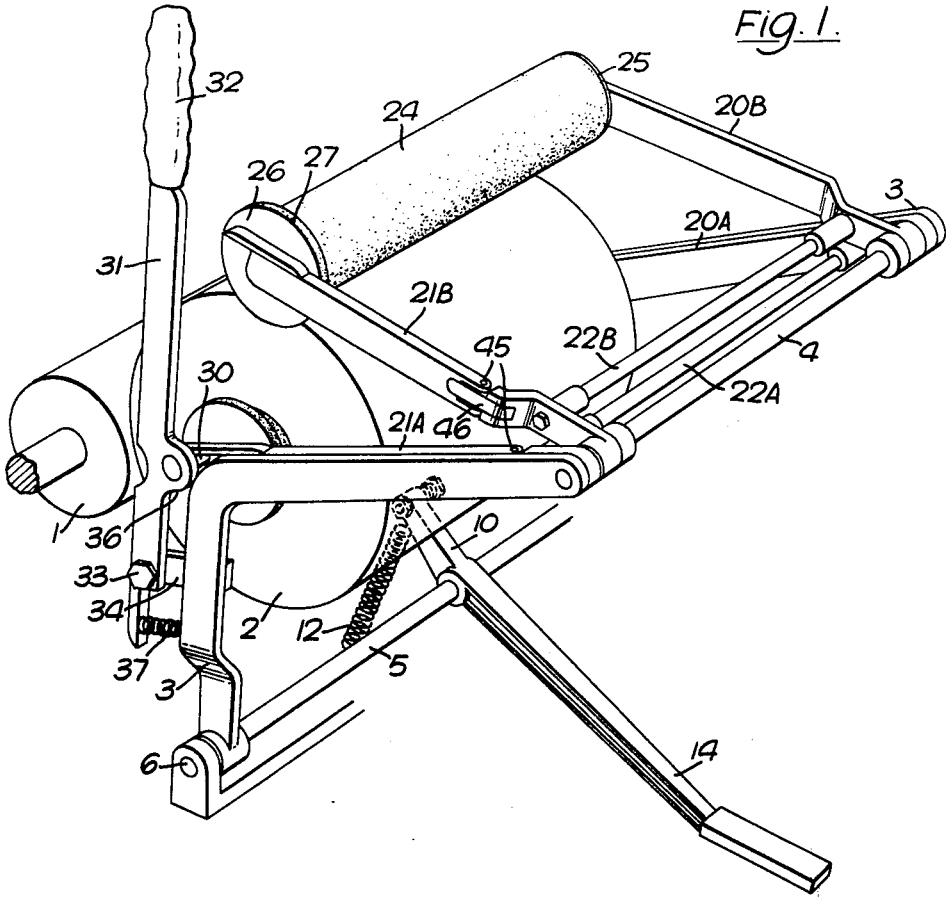
FIGS. 1 to 3 are perspective views showing successive stages in the operation of a manually operated machine.
Figure 2:
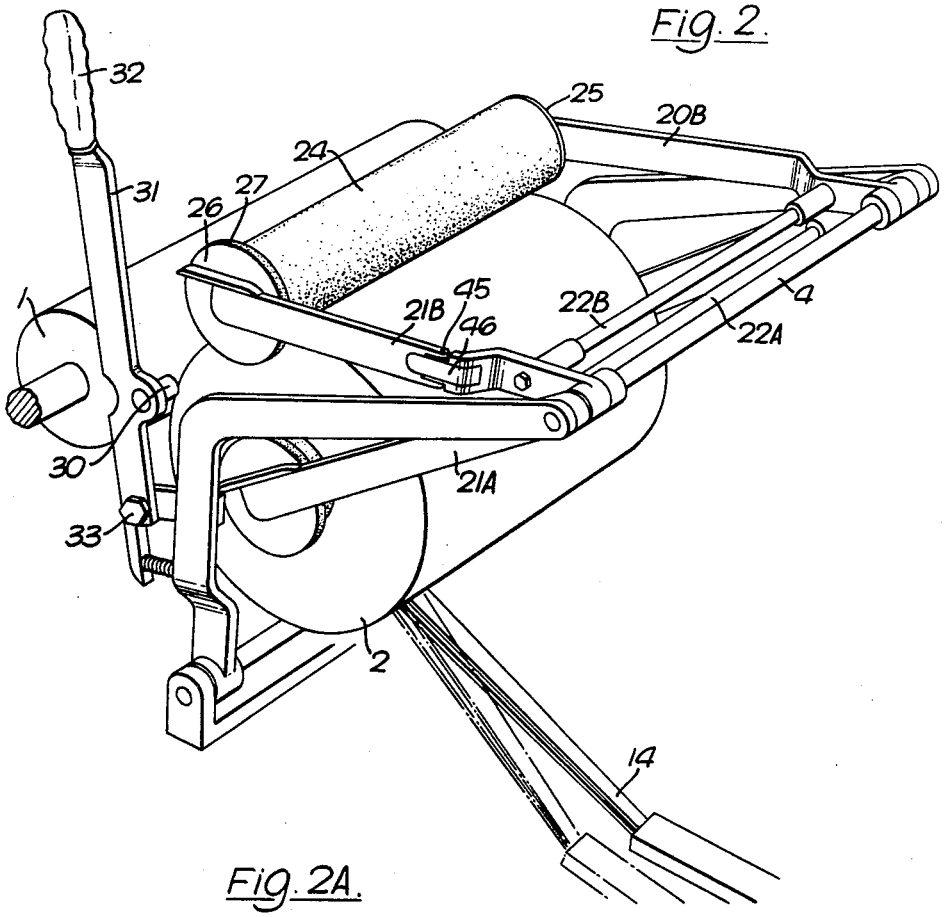
Figure 3:
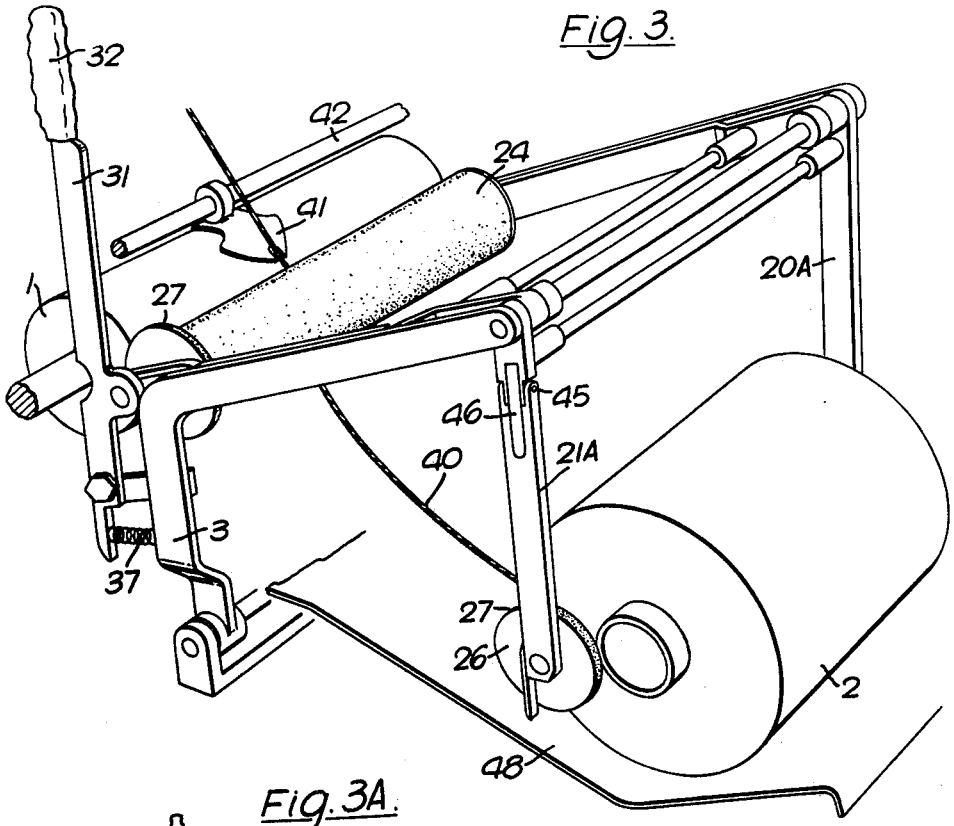

Turning first to the construction of FIGS. 1 to 3, the winding head illustrated comprises a driving roller 1 which, in the stage shown in FIG. 1, is just completing the formation of a package 2. The package is supported by a supporting frame comprising a pair of L-shaped arms 3 which are connected together at their upper free ends by a rod 4 and at their lower free ends by a rod 5 having projecting ends carried by bearings, one of which is seen at 6. The assembly so far described constitutes a rigid framework capable of pivoting about the axis of the rod 5 so as to move towards and away from the driving roller 1. The rod 5 is provided with a lateral projection 10 to the end of which is connected a tension spring 12, the other end of which is fixed to the frame of the machine. The tension in the spring therefore presses the frame as a whole towards the driving roller 1, but the frame is moved away from the driving roller as the package 2 builds up, against the tension in the spring 12. Opposite the projection 10 is a foot pedal 14 by means of which the frame can be moved away from the driving roller 1 during operation, for example for the repairing of an end break.

The supporting frame includes a pair of carriers for package centres, one carrier comprising a pair of arms 20B and 21B which are inter-connected by a cross member 22B so that they turn together as a unit about the rod 4 forming part of the supporting frame. The free ends of the arms 20B and 21B support a package centre 24 mounted between end caps 25 and 26, the latter being formed with a roughened rim 27. In the position shown in FIG. 1, the other of the two pairs of arms, shown as 20A and 21A, support the package whereas the arms 20B, 21B support an empty package centre, themselves being supported by the cross-member 22A. As the package 2 grows in size it engages the empty package support and thus takes the weight of the package centre and the arms 20B, 21B.

As just mentioned the pairs of arms are free to turn about the rod 4 and in order to support the package 2 in the operative position in contact with the driving roller 1, the arms are supported by a support member 30 carried by an arm 31 provided with a handle 32 and pivoted at 33 to a short transverse member 34 fitted to one of the arms 3 of the supporting frame. The arm 31 is biased into the position shown in FIG. 1, in which a projection 36 adjacent the support member 30 engages one of the arms 3, by a compression spring 37 acting on a short extension of the arm 31 on the other side of its pivot 33.

Figure 1A:
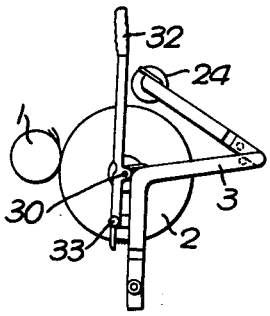
Figure 2A:
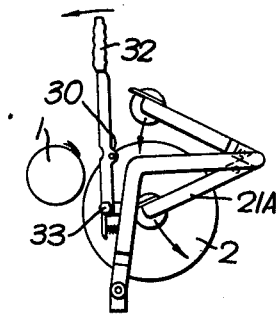

When the winding of the package 2 is complete, its carrier comprising the arms 20A and 21A is released under the control of the operator by moving the handle 32 to the left as seen in FIG. 1 and then allowing it to return under the control of the spring 37. This temporarily removes the support member 30 from the arm 21A and the package 2 starts to fall as seen in FIG. 2. Prior to the operation of the handle 32, the relative positions of the parts are best seen from the reduced scale end view FIG. 1A. The arms 20A and 21A are obscured by the nearer arm 3, but the engagement with the support member 30 can be seen and this can be contrasted with the view of FIGS. 2 and 2A in which the support member 30 has been moved to the left and the arms 20A and 21A have started to fall.

Figure 3A:
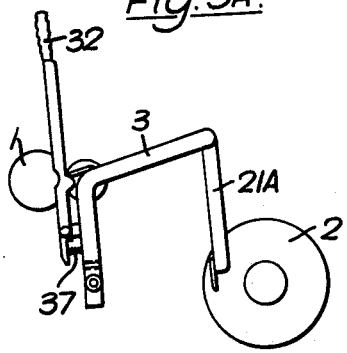

Immediately after this, the handle 32 is returned to the right again so that the support member 30 is in position to receive the arm 21B as seen in FIGS. 3 and 3A. Meanwhile, the package 2 has continued to fall until the arms 20A and 21A reach a vertical position as seen in FIG. 3. This leaves the yarn 40 (not seen in FIGS. 1 and 2) extending to the package 2 so that it is readily accessible for cutting by the operator who can then lift the free end, and drop it over the roughened end cap 27 of the package centre 24 which, no longer being supported by the package 2, has dropped into the operative position in engagement with the driving roller 1. The end of the yarn 40 is gripped by the end cap 27 and winding on the centre 24 the continues, the necessary traversing action being provided by a traversing guide 41 which is movable along a rod 42 and is not seen in FIGS. 1 and 2.

Figure 8:
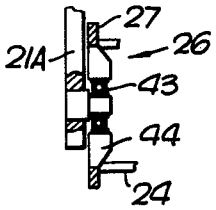
FIG. 8 is a detailed view to an enlarged scale showing an end cap for a package centre.

FIG. 3 shows the package 2 just after release from between the end caps 25 and 26, this release occurring automatically as a result of the momentum of the package 2 and the design of each end cap as seen in the detailed view of FIG. 8.

Each end cap turns on a bearing 43 and in addition to the rim portion 27 includes a central plug 44 for fitting into the hollow interior of a package centre 24. The plug 44 is tapered to provide a camming action to force the end caps apart under the increased transverse force produced after the package is released.

The arms 21A and 21B are pivoted at 45 (best seen in FIGS. 1 and 2) and held in the position in which each end cap 26 engages a respective package centre by a leaf spring 46, the effect of which is overcome when the weight and momentum of the package 22 produce sufficient transverse force to cam the end cap 26 outwardly. Release of the package 2 is prevented during the winding operation by the presence of the upper part of the arm 3 immediately outside the arm 21A.

As soon as the package is released as seen in FIG. 3, it rolls onto a tray 48 (seen only in FIG. 3) for removal by the operator when convenient. The arms 20A and 21A remain in the position of the FIG. 3, that is to say hanging freely and the operator can then insert a fresh package centre between the end caps 25 and 26, the arm 21A yielding about the pivot 45 for this purpose. When the fresh package centre 24 has been inserted in position, it is lifted by the operator to the position shown in FIG. 1, in which the arms 20A and 21A are supported by the cross-member 22B. As the fresh package starts to build up, it takes over the support of the arms 20A and 21A and the operation already described is repeated again.

It will be understood that prior to moving into the operative position in which it is engaged by the driving roller 1, the package centre 24 is controlled by the arms 20B and 21B which constrain it to move in a part-circular path and that these arms exert further control after the package has been released at the completion of the winding operation. A similar control could be exerted if the pairs of arms 20A, 21A and 20B, 21B were to be replaced by a single pair of discs capable of turning about the rod 4.

FIGS. 4 to 7 illustrate a basically similar apparatus intended for automatic operation, that is to say in which various of the steps of the operation described as being carried out by the operator are carried out mechanically under automatic control. Insofar as parts of the apparatus shown in FIGS. 4 to 7 correspond to parts of the apparatus shown in FIGS. 1 to 3, they are identified by the same reference numerals and are not described in any further detail.

Figure 4:
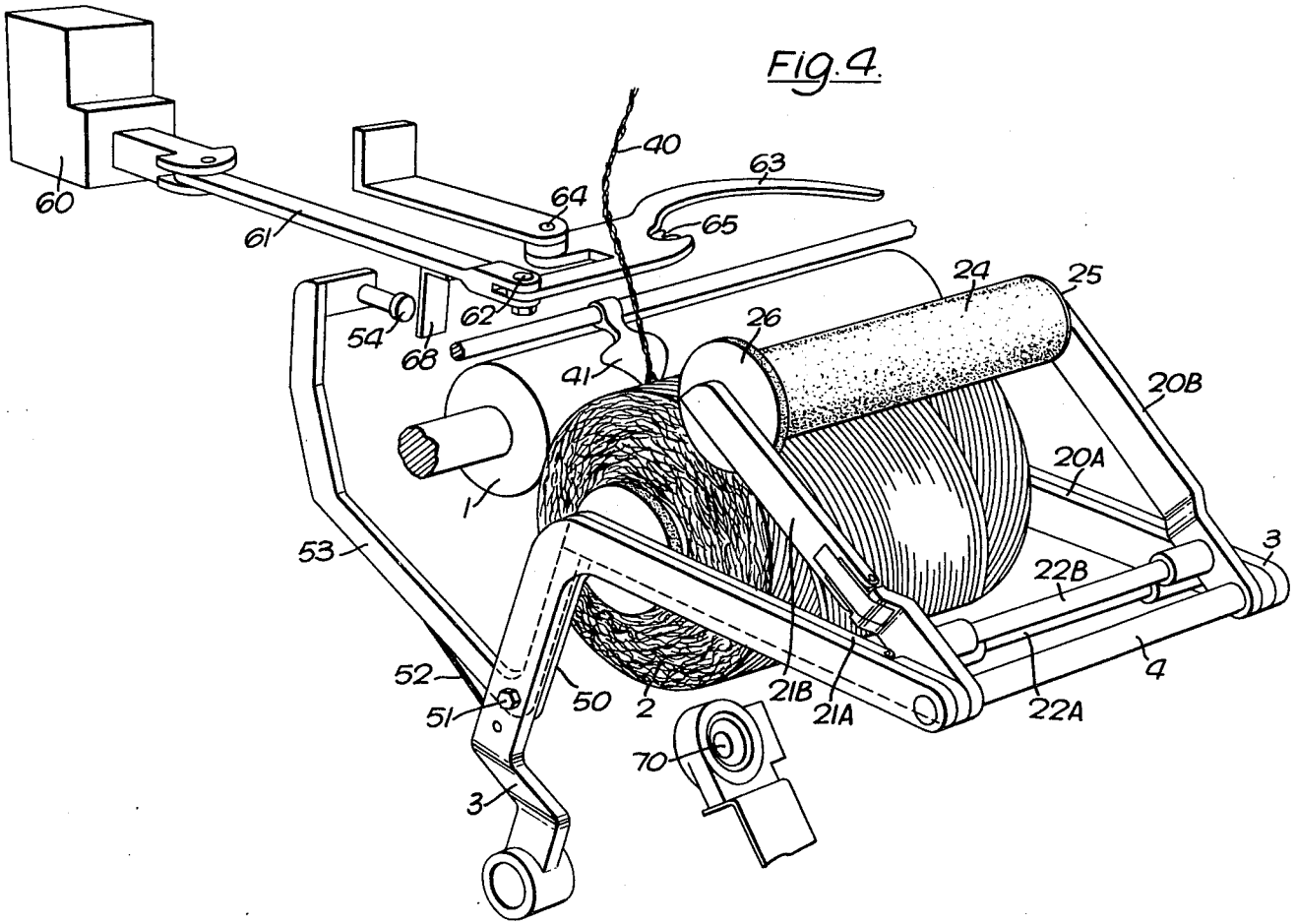
FIGS. 4 to 7 are perspective views showing similar stages in the operation of an automatic machine.

FIG. 4 illustrates a stage in the operation corresponding to that shown in FIG. 1 in which a package 2 is nearing completion. The package 2 is again carried between end caps 25 and 26 on carrier arms 20 and 21, but in this modified construction, the arm 21A is differently supported, i.e. by the upper end of a cranked arm 50 which is pivoted at 51 to one arm 3 of the supporting frame. The arm is biased into the position shown by a leaf spring 52 and an extension of the arm 50 on the other side of the pivot 51 is shown as 53 and is fitted with a striker 54. The striker 54 is operated automatically as a substitute for operation of the handle 32 in the construction shown in FIGS. 1 to 3.

Figure 5:
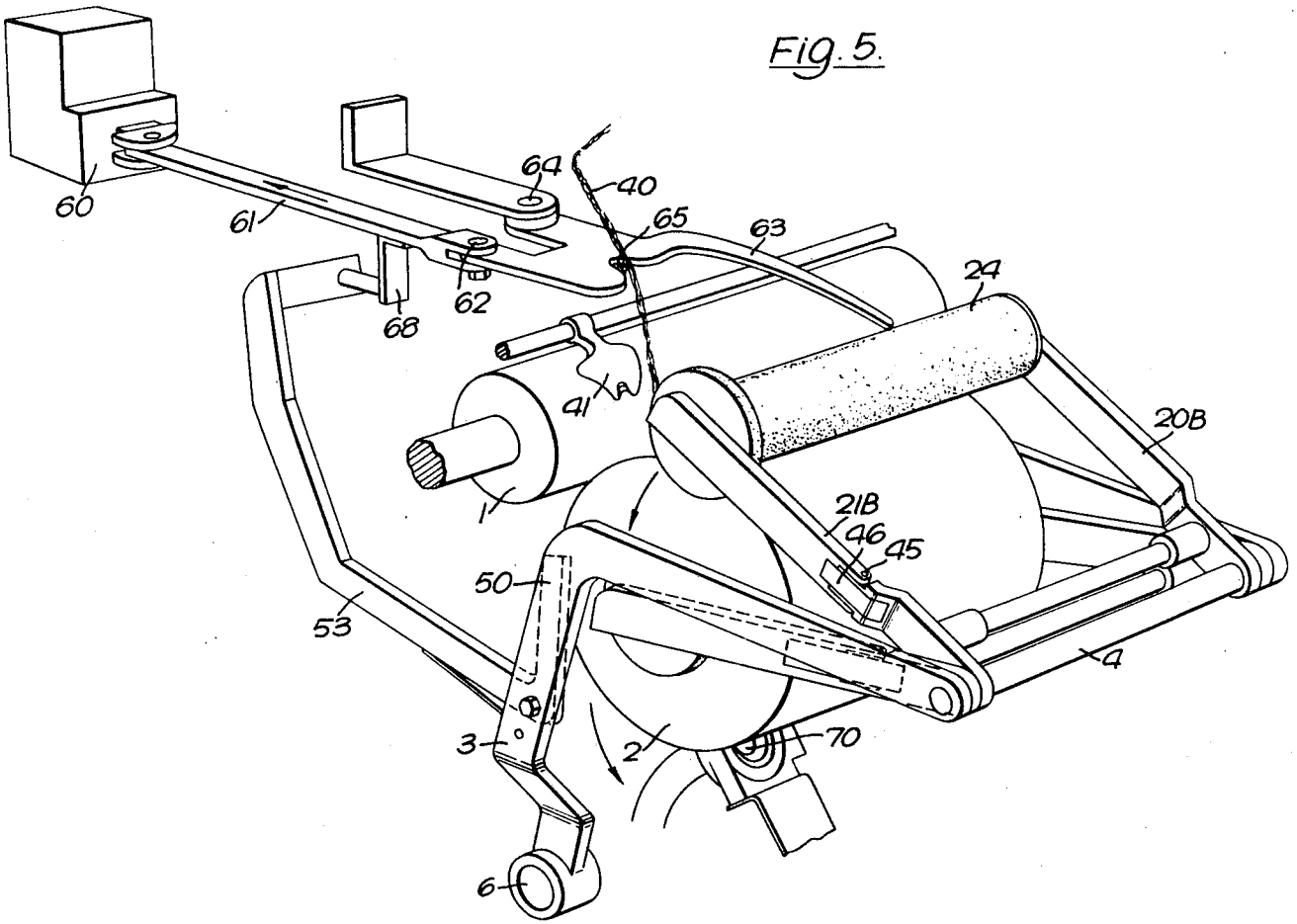

When the winding of the package 2 is complete, as indicated by a yardage counter (not shown) a signal is transmitted to operate a solenoid 60 to retract an operating bar 61 which is pivoted at 62 to a yarn-engaging finger 63 which is itself pivoted to a fixed point 64. This causes the finger 63 to swing in a clockwise direction to engage the yarn 40 and remove it from the traversing guide 41, the yarn then being located by a notch 65 in the finger 63. The bar 61 also carries a bracket 68 which is brought into engagement with the striker 54 so as to pivot the arm 50, 53 in an anti-clockwise direction as seen in FIG. 5 to remove support from the arm 21A which then starts to fall as illustrated.

As the package 2 starts to fall, the spring 12 pulls the supporting frame comprising the arms 3 towards the driving roller 1, thus clearing the striker 54 from the bracket 68 (which temporarily remains in the position shown in FIG. 5) and thus allowing the cranked arm 50, 53 to return to its supporting position under the control of the leaf spring 52. The upper end of the arm 50 is thus ready to receive the arm 21B as it swings downwardly with the package 2.

Figure 6:
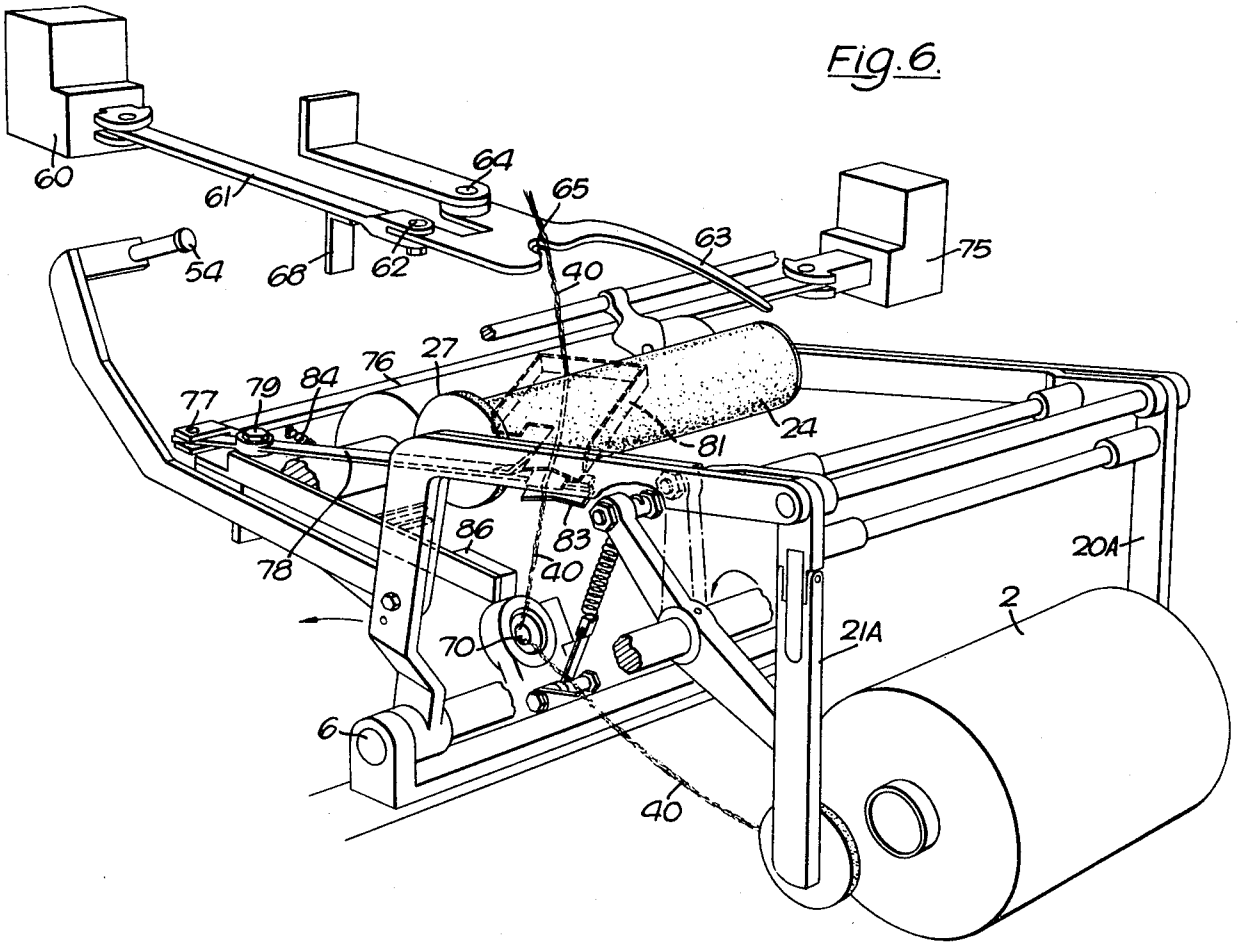
Figure 7:
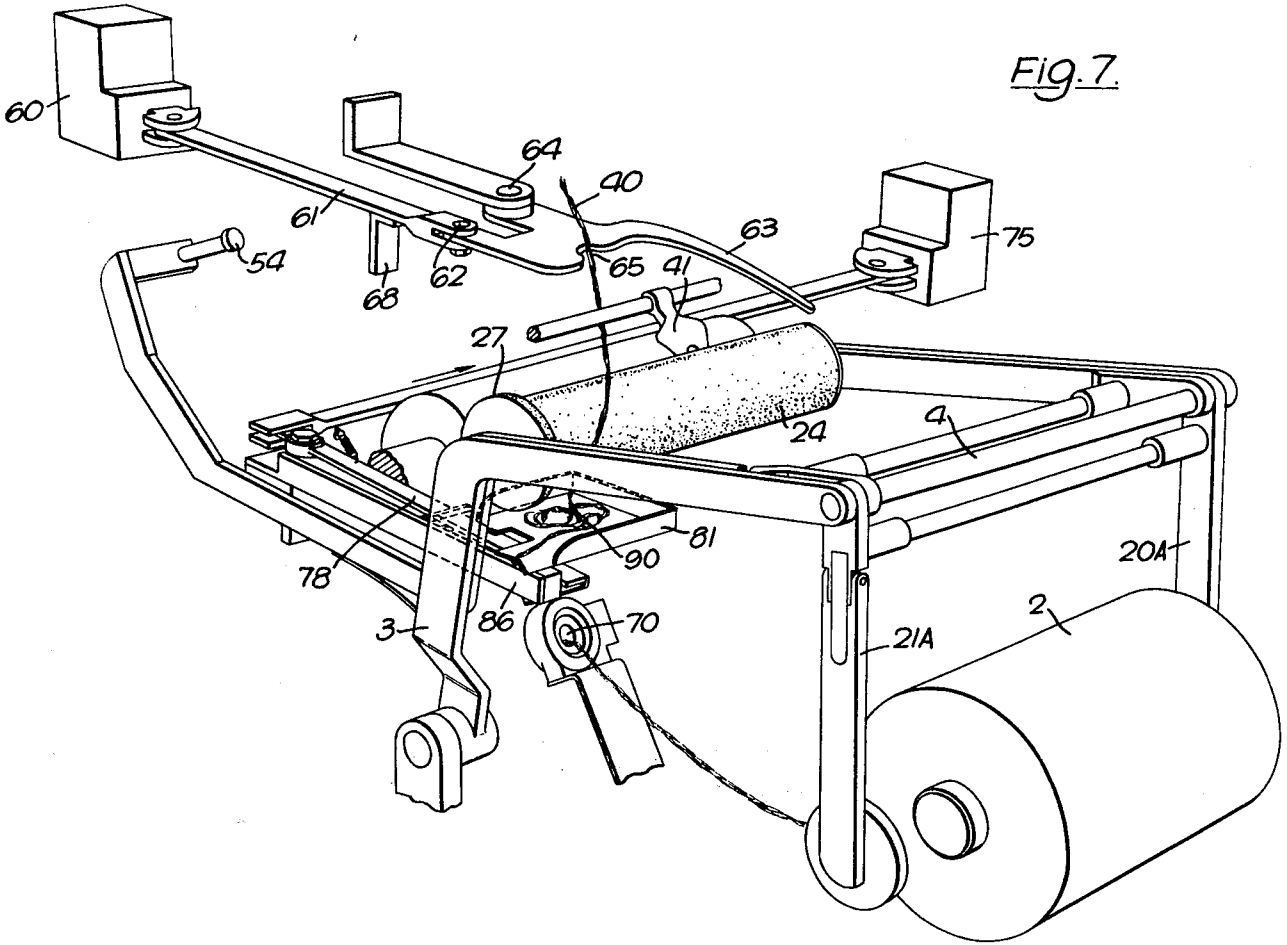

The yarn 40 continues to be delivered and to avoid any excess collecting prior to the next stage in the operation, the delivered yarn is taken up by a suction nozzle 70 as shown in FIG. 6. A second solenoid 75 (seen only in FIGS. 6 and 7) then comes into operation in timed relationship with the first solenoid 60 and retracts a bar 76 running parallel with the driving roller 1. The bar 76 is pivoted at its left hand end at 77 to a further arm 78 which is pivoted to the frame at 79 and normally lies generally parallel with and beneath the driving roller 1. At its right hand end the arm 78 carries a tray 81 (shown in dotted lines in FIG. 6 because it is obscured by the package centre 24) and a cutting blade 83. Movement of the bar 76 to the right causes the arm 78 to turn about its pivot against the effect of a spring 84 so that the blade 83 engages the yarn 40 and carries it with it into engagement with a cutting block 86 as seen in FIG. 7. The block 86 is preferably of a resilient material such as a hard synthetic rubber. This action cuts the yarn and yarn which is subsequently delivered starts to collect in the tray 81 as seen at 90 in FIG. 7.

In this position, the tray 81 is situated immediately below the roughened end cap 27 so that as the quantity of yarn 90 in the tray 81 starts to build up, it is picked up by the cap 27 and winding restarts. In practice it has been found that a delay of about only one to one and a half seconds is all that is required for the yarn to be picked up by the end cap 27 and a timer is set to operate after a delay of this order to de-energise the solenoid 75 and thus to return the bar 76 and hence also the tray 81 to its initial position. The solenoid 60 is also de-energised at the same time, causing the finger 63 to swing back to its starting position as shown in FIG. 4 and thus allowing the yarn 40 to return to the yarn guide 41 so that normal winding operation in resumed.

In the meanwhile, the completed package 2 is automatically freed from between the arms 20A and 21A in the same manner as described with reference to FIG. 3 and needs to be removed by the operator, thus withdrawing the end of the yarn from the suction nozzle 70. At the same time as removing the completed package 2, the operator fits a new package centre between the arms 20A and 21A and lifts this centre to the position shown in FIG. 4. It is thus only this small part of the operation which requires to be carried out manually, i.e. removal of a full package and the fitting of a new package centre and the timing of this is in no way critical since the operator will have a time interval equal to that required for the winding of a full package in which to take the necessary action.

Although the automatic operation is described as electrically controlled, i.e. by the solenoids 60 and 75, pneumatic control may be used instead, the solenoids being replaced by pneumatic cylinders. Another modification which may be useful in practice is to replace the tray 48 by a conveyor so that all the finished packages are automatically delivered to one end of the machine.

It will be understood that the operation described, both in its manual and its automatic forms, is quite independent of the source from which the yarn 40 is drawn so that, although ideally suited for use with an open end spinning machine, a winder in accordance with the invention can equally well be used with other types of continuous yarn production.

I claim:

1. A winding head comprising a supporting frame, a driving roller, means mounting said supporting frame for movement towards and away from said driving roller, said supporting frame including a plurality of pairs of interconnected arms pivoted about a common axis each said pair of arms including means for mounting a package center for rotation between the arms of each said pair, a support member carried by said frame for engaging at least one arm of each pair of arms in an operative position for supporting a package center in an operative position in which said center is capable of cooperation with said driving roller, means mounting said support member for movement from its supporting position to release a package wound on said center to allow said package to move away from the operative position, each said pair of arms serving to control the movement of a package center along a part circular path into the operative position and then, after release of said support member, to allow a package carried by the center to move along a continuation of the part circular path away from the operative position, means hinging at least a part of one arm of each pair to allow said arm to yield to automatically release said package as it moves away from the operative position and means preventing said yielding of said arm to release said package until said package leaves the operative position.

2. A winding head according to claim 1, wherein said supporting frame further comprises a pair of main support arms upon which said plurality of pairs of interconnected arms are pivoted, each pair of arms having the means for mounting a package center thereon being disposed in alignment with said main supporting arms between said main supporting arms in close proximity thereto in said operative position whereby said hinged arm is prevented from releasing said package center during winding in the operative position.

3. A winding head according to claim 1 in which said means for mounting a package centre between the said arms comprises pairs of end caps, each mounted for

4. A winding head according to claim 1 and including a leaf spring for holding said hinged part of said arm in the operative position thereof.

5. A winding head according to claim 3 in which each end cap includes a central plug for fitting into the hollow interior of a package centre and the plug of at least one of said end caps is tapered to provide a camming action to force said end caps apart under a transverse force in excess of the weight of a complete package.

6. A winding head according to claim 1 and including mechanism for moving said support member to release a package centre and an associated package under the control of a device responsive to the package having achieved a predetermined size.

7. A winding head according to claim 6 and also including a guide for traversing yarn along a package being wound and a pivoted member operated in timed relation with the movement of said support member for removing yarn being wound from said guide.

8. A winding head according to claim 7 and also including a blade operating in timed relation with the movement of said support member, for cutting the yarn, a receptacle for collecting the resultant accumulation of yarn and means for moving the receptacle into the path of the yarn also in timed relation with the movement of the support member.

9. A winding head according to claim 8 in which the means for moving said receptacle operates to locate said receptacle in the vicinity of one end cap supporting a package centre for the next package to be wound, said end cap having a rim which is configured to engage the yarn in said receptacle to start the winding of the next package.

10. A winding head according to claim 9 and also including a suction nozzle for taking up yarn in the interval between the release of a completed package and the operation of said cutting blade.

11. A winding head according to claim 1 and including means for receiving a wound package after release.

12. A winding head according to claim 11 in which the receiving means is in the form of a tray.

* * * * *